US011780654B2

(12) United States Patent
Farach

(10) Patent No.: US 11,780,654 B2
(45) Date of Patent: Oct. 10, 2023

(54) CONTAINER WITH TEARABLE LID

(71) Applicant: PLASTIFAR, S.A., Santo Domingo (DO)

(72) Inventor: Alejandro Farach, Santo Domingo (DO)

(73) Assignee: PLASTIFAR S.A., Santo Domingo (DO)

( * ) Notice: Subject to any disclaimer, the term of this patent is extended or adjusted under 35 U.S.C. 154(b) by 101 days.

(21) Appl. No.: 15/935,785

(22) Filed: Mar. 26, 2018

(65) Prior Publication Data

US 2019/0291927 A1 Sep. 26, 2019

(51) Int. Cl.
*B65D 43/02* (2006.01)
*B65D 21/02* (2006.01)

(52) U.S. Cl.
CPC ..... *B65D 43/0254* (2013.01); *B65D 21/0219* (2013.01); *B65D 2543/00194* (2013.01); *B65D 2543/00296* (2013.01); *B65D 2543/00324* (2013.01); *B65D 2543/00509* (2013.01); *B65D 2543/00842* (2013.01)

(58) Field of Classification Search
CPC ..... B65D 2543/00324; B65D 2543/00842; B65D 43/0254; B65D 2543/00009; B65D 2401/60; B65D 43/166; B65D 43/169
See application file for complete search history.

(56) References Cited

U.S. PATENT DOCUMENTS 7,073,680 B2 7/2006 Boback et al.
7,118,003 B2 10/2006 Sellari et al.
7,712,626 B2 5/2010 Vovan
7,992,743 B2 8/2011 Vovan
9,016,503 B2 4/2015 Barbier et al.
9,132,942 B2 9/2015 Nikaein
9,365,331 B2 6/2016 Gingras et al.
9,409,683 B2 8/2016 Gingras et al.
9,493,277 B2 * 11/2016 Parikh ..... B65D 43/0254
9,624,009 B2 4/2017 Gingras et al.
2016/0355303 A1 * 12/2016 Kalmanides ..... B65D 43/0239
2017/0001766 A1 * 1/2017 Cimmerer ..... B65D 43/162
2018/0118420 A1 * 5/2018 Allers ..... B65D 43/0235
2018/0222623 A1 * 8/2018 Knutson ..... B65D 1/36

* cited by examiner

*Primary Examiner* — Don M Anderson
(74) *Attorney, Agent, or Firm* — Grant Attorneys at Law PLLC

(57) ABSTRACT

A container may include a base having a bottom and a plurality of side walls extending upward from the bottom to define an interior therebetween, and a lid configured to engage with the base in a closed configuration to enclose the interior. The container may also include a connecting portion by which the base and the lid may be connected in an initial state. The base may have an extension portion extending laterally outward from a lateral side of the base and connected to the connecting portion via a folding line about which the connecting portion and the lid may be rotatable with respect to the base between the closed configuration and an open configuration. The lid may also have an extension portion extending laterally outward from a lateral side of the lid and connected to the connecting portion via a tear line. The tear line may be weakened such that the lid may be separable from the connecting portion and the base at the tear line while the connecting portion may remain intact with the base.

18 Claims, 4 Drawing Sheets

CONTAINER WITH TEARABLE LID

FIELD OF TECHNOLOGY

The present disclosure pertains to a container with a tearable lid, and a method of manufacturing thereof.

BACKGROUND

Plastic containers are used throughout the food industry to hold various kinds of perishable foods. The containers usually contain a base that contains the food and a lid that closes the container in a sealed manner. This allows the food to maintain a certain level of freshness and prevent or limit the amount of germs and/or bacteria that may enter the container and therefore contaminate the food. With many containers, the lid and base are separate components that allow for the container to be freely opened and closed. With such containers, however, it may be difficult for a consumer to discern if the container has been opened after the food has been packaged therein, and therefore may be contaminated with germs, prior to purchasing the particular food packaged in the container.

Accordingly, an improved, container with a tearable lid, and a method of manufacturing thereof, is presented that allows for a consumer to easily identify if the container has been tampered with by another.

BRIEF DESCRIPTION OF THE DRAWINGS

Referring now to the drawings, illustrative embodiments are shown in detail. Although the drawings represent some embodiments, the drawings are not necessarily to scale and certain features may be exaggerated, removed, or partially sectioned to better illustrate and explain the present disclosure. Further, the embodiments set forth herein are not intended to be exhaustive or otherwise limit or restrict the claims to the precise forms and configurations shown in the drawings and disclosed in the following detailed description.

DETAILED DESCRIPTION

Figure 1:
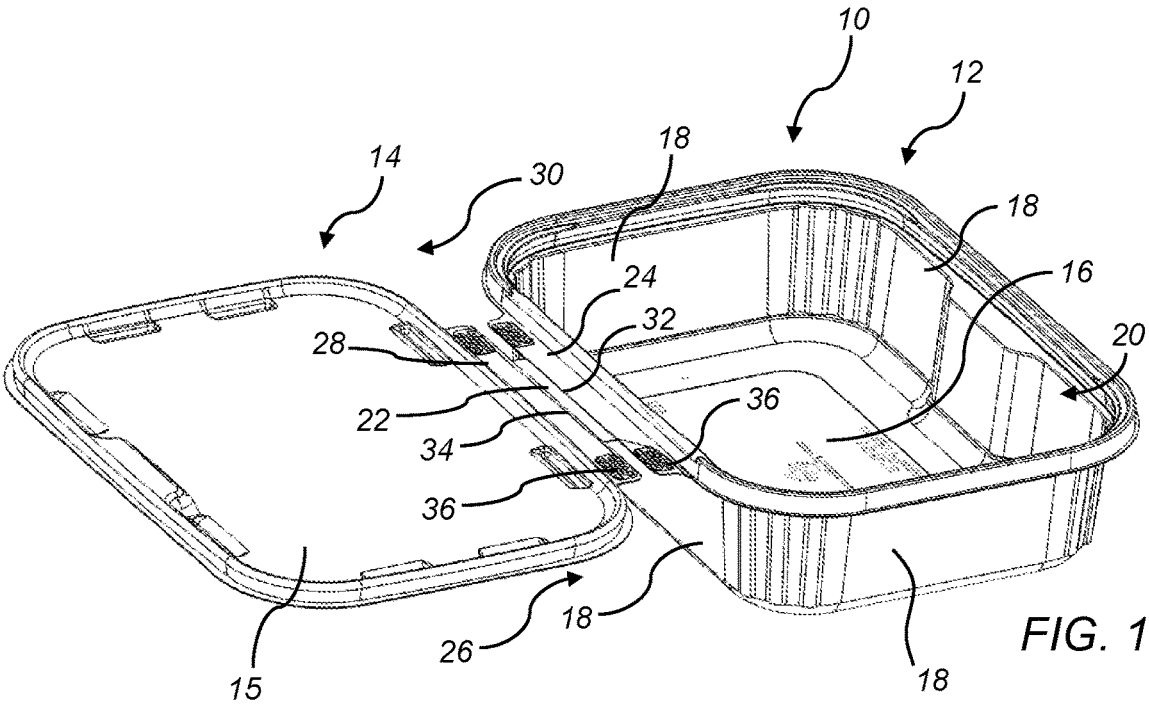
FIGS. 1 and 2 are perspective and top views, respectively, of an exemplary container in an open configuration in an initial state in which a lid and a base of the container are connected.

To provide a consumer with an easily identifiable indicator of tampering of a container, the container may include a base having a bottom and a plurality of side walls extending upward from the bottom to define an interior therebetween, and a lid configured to engage with the base in a closed configuration to enclose the interior. The container may also include a connecting portion by which the base and the lid may be connected in an initial state. The base may have an extension portion extending laterally outward from a lateral side of the base and connected to the connecting portion via a folding line about which the connecting portion and the lid may be rotatable with respect to the base between the closed configuration and an open configuration. The lid may also have an extension portion extending laterally outward from a lateral side of the lid and connected to the connecting portion via a tear line. The tear line may be weakened such that the lid may be separable from the connecting portion and the base at the tear line while the connecting portion may remain intact with the base.

An exemplary method for manufacturing a container with indicators of tampering, such as the container described above, may include forming from a single sheet of a plastic material a base and a lid connected to each other via a connecting portion. The base may have a bottom and a plurality of side walls extending upward from the bottom to define an interior therebetween, and an extending portion extending laterally outward from a lateral side of the base and connected to the connecting portion via a first line. The lid may have an extending portion extending laterally outward from a lateral side of the lid and connected to the connecting portion via a second line. The method may then include folding the plastic material along the first line such that the connecting portion and the lid may be rotatable about the first line with respect to the base between a closed configuration, in which the lid is engaged with the base to enclose the interior, and an open configuration. The method may further include weakening the plastic material along the first line such that the lid is separable from the connecting portion and the base at the second line while the connecting portion remains intact with the extension portion of the base.

Referring now to the figures, FIGS. 1-4 illustrate an exemplary container 10 used to sealably hold food or other items while providing a means for detecting any tampering with the container 10. The container 10 generally may include a base 12 and a lid 14. The base 12 and the lid 14 may be formed from a single sheet of plastic such that they are connected in an initial state. The base 12 generally may include a bottom 16 and a plurality of side walls 18 extending upward from the bottom 16. The bottom 16 and the side walls 18 may define an interior space 20 in which the food or other items may be contained. The base 12 and the lid 14 generally may be configured to engage with each other in a closed configuration to enclose the interior space 20. The lid 14 may include a top 15 that substantially covers the interior space 20.

Figure 2:
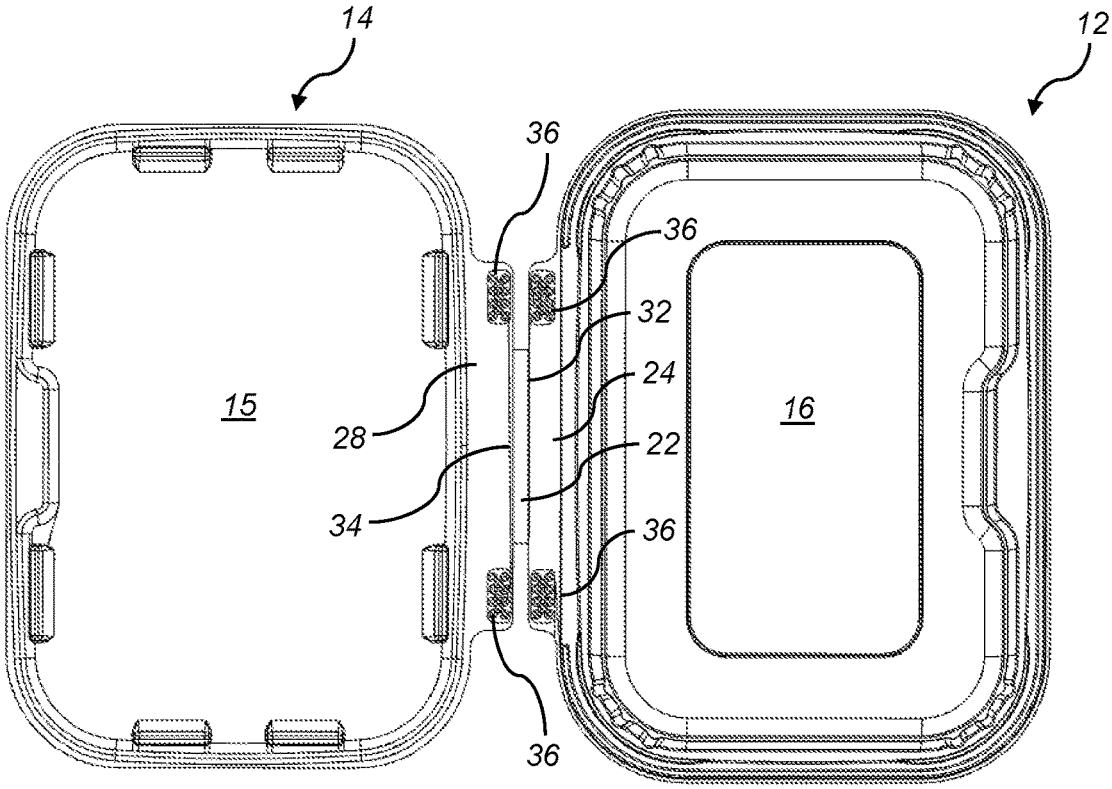
Figure 3:
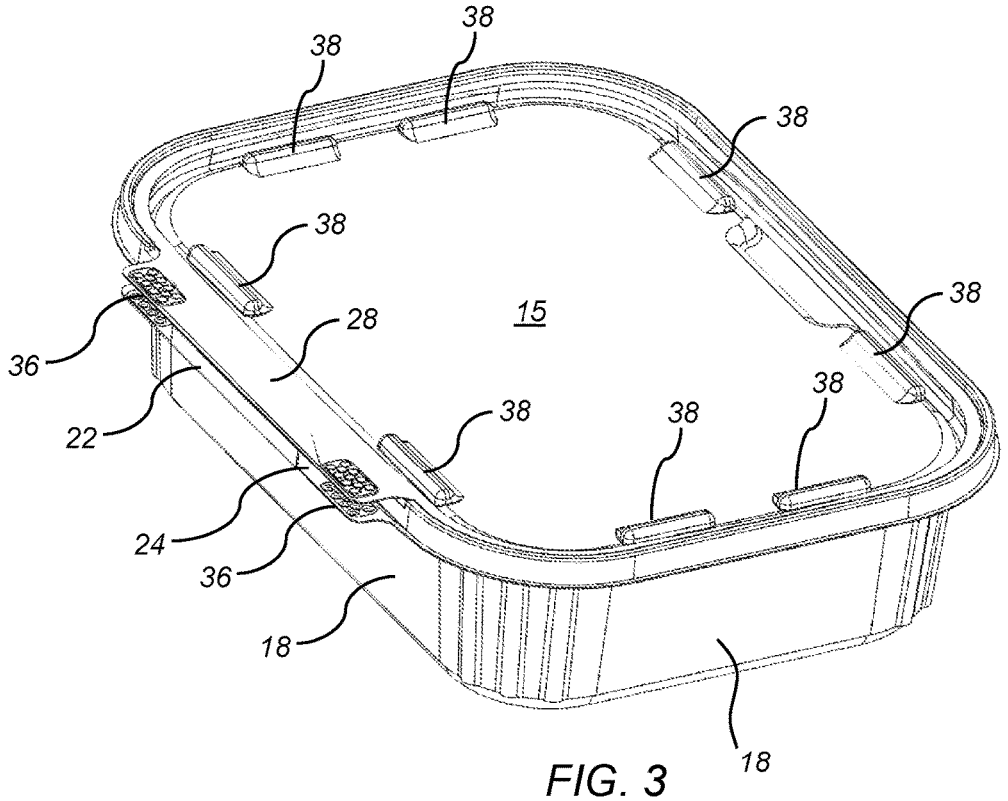
FIGS. 3 and 4 are perspective and side view, respectively, of the exemplary container of FIGS. 1 and 2 in a closed configuration in the initial state.
Figure 4:
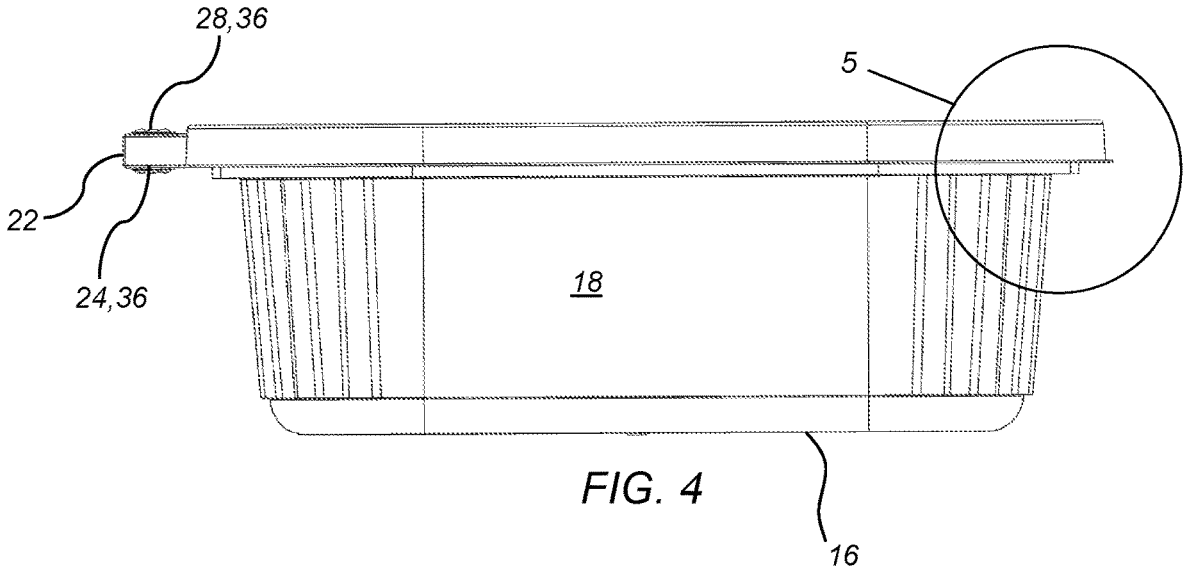

In the initial state, the base 12 and the lid 14 may be connected to each other by a connecting portion 22. To achieve this connection, the base 12 may include an extension portion 24 extending laterally outward from a lateral side 26 of the base 12. The lid 14 may similarly include an extension portion 28 extending laterally outward from a lateral side 30 of the lid 14 that corresponds to the lateral side 26 of the base 12. The extension portion 24 of the base 12 may be connected to the connecting portion 22 via a folding line 32. The base 12 and the lid 14 generally may be rotatable with respect to each other about the folding line 32 to move from an open configuration, as illustrated in FIGS. 1 and 2, to the closed configuration, as illustrated in FIGS. 3 and 4. The extension portion 28 of the lid 12 may be connected to the connecting portion 22 via a tear line 34. The tear line 34 generally may be a line at which the material of the container 10 is weakened such that the base 12 and the lid 14 may be physically separated from each other along the tear line 34, for example, via tearing, as explained in more detail hereinafter, while the connecting portion 22 remains intact with the extension portion 24 of the base 12.

The extension portions 24 and 28 may extend substantially a same distance laterally outward such that the connecting portion 22 may be oriented substantially vertically in the closed configuration, as seen in FIGS. 3 and 4. The extension portions 24 and 28 may also have substantially a same longitudinal length, while the connecting portion 22 generally may have a shorter longitudinal length than the extension portions 24 and 28 such that longitudinal ends of the extension portions 24 and 28 may extend beyond the connecting portion 22 in the longitudinal direction. The connecting portion 22 may also be substantially centered with respect to the extension portions 24 and 28 in the longitudinal direction. Such a configuration may allow for opposing ends of each of the extension portions 24 and 28 that extend beyond the connecting portion 22 to be equally sized, such that any one of these ends may be sufficiently gripped in the closed configuration.

To ease the gripping of these ends, the extension portions 24 and 28 may further include gripping portions 36 at the longitudinal ends thereof. The gripping portions 24 and 28 may be areas at which the material of the container 12 is roughened to create friction between a consumer's fingers. In addition or alternatively, the gripping portions 36 may include a series of bumps, corrugations, or the like to create an uneven surface for improved grippability. The gripping portions 36 may be located on a top surface and/or a bottom surface of the extension portions 24 and 28. While the figures illustrate both of the extension portions 24 and 28 each having gripping portions 36 at both longitudinal ends, it should be appreciated that the gripping portions 36 may be located at just one of the longitudinal ends, for example, if the connecting portion 22 is off center with respect to the extension portions 24 and 28 in the longitudinal direction such that only the one longitudinal end extends beyond the connecting portion 22 in the longitudinal direction.

In alternative embodiments not shown, there may be more than one connecting portion 22 that may be equally spaced apart in the longitudinal direction from a center of the extension portions 24 and 28. This may create one or more intermediate portions of the extension portions 24 and 28 located between the connecting portions 22 in the longitudinal direction. The intermediate portion(s) may be used to grip the extension portions 24 and 28 in addition to or in lieu of the longitudinal ends, and may further include gripping portions 36 to improve grippability, as described above.

In the initial state and closed configuration, the container 10 generally cannot be opened without separation of the base 12 and the lid 14. Thus, a consumer can simply look at the container 10 to see if the base 12 and the lid 14 are still connected by the connecting portion 22 to determine if the container 10 has been preemptively opened or otherwise tampered with. An easily identifiable indicator of the connection between the base 12 and the lid 14 may be the substantially vertical orientation of the connecting portion 22, as explained above and illustrated in FIGS. 3 and 4. If the connecting portion 22 is not vertically oriented, it is clear that the base 12 and the lid 14 are no longer connected.

To separate the base 12 and the lid 14 when the container 10 is in the initial state and closed configuration such that the contents stored therein can be accessed, the consumer 10 may grip a portion of the extension portion 24 of the base 12 and a portion of the extension portion 28 of the lid 14, for example, the longitudinal ends of the extension portions 24 and 28, and apply at least an upward force on the extension portion 28 of the lid 14. Such an upward force may cause the lid 14 to separate or from the connecting portion 22 at the tear line 24, which as explained above may be weakened to facilitate the separation. The connecting portion 22 generally may stay intact with the base 12 at the extension portion 24. The base 12 and the lid 14 may then be freely opened and closed.

Figure 5:
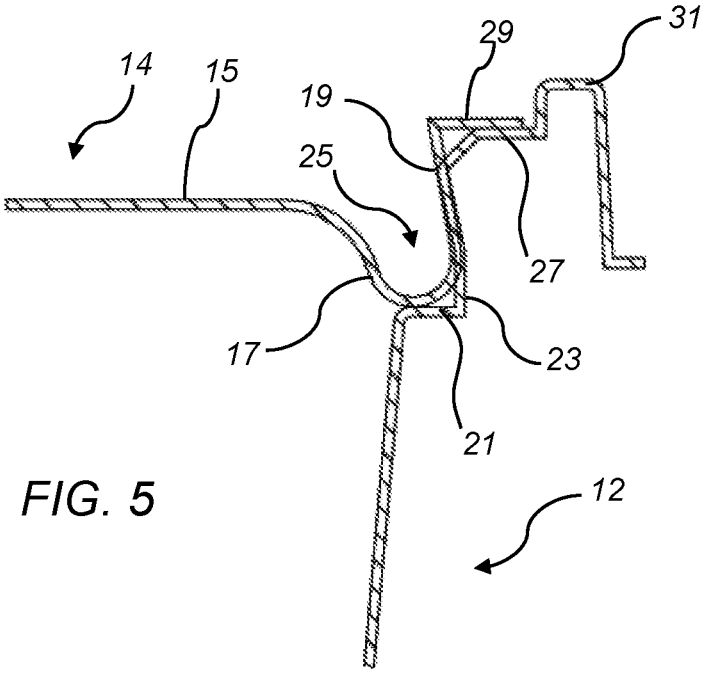
FIG. 5 is a partial cross-sectional view of the exemplary container of FIGS. 1-4 in the closed configuration.

Referring now to FIG. 5, to maintain the container 10 in the closed configuration, the lid 14 may also include a rounded or bubble portion 17 extending downward from and arranged around at least a portion of a periphery of the top 15, and a lid sealing wall 19 extending upward from the bubble portion 17. The base 12 may include a first shoulder 21 extending outward from the side walls 18 in a direction away from the interior space 20, and a base sealing wall 23 extending upward from the first shoulder 21 to form a pocket 25 configured to receive the bubble portion 17. The rounded shape of the bubble portion 17 may allow for compression of the lid 14 in a downward direction to absorb downward forces applied to the top 15 of the lid.

When the bubble portion 17 is received in the pocket 25, the lid sealing wall 19 and the base sealing wall 21 may engage with each other via a compression fit to maintain the container 10 in the closed configuration. To further the compression fit, the base sealing wall 23 and the first shoulder 21 may form an acute angle. However, it should be appreciated that the base sealing wall 23 and the first shoulder 21 may be oriented at a right angle or an obtuse angle.

The base 12 may further include a second shoulder 27 extending outward from the base sealing wall 23, and the lid 14 may further include a lip 29 extending outward from the lid sealing wall 19 and that engages with the second shoulder 27 to further maintain the container 10 in the closed configuration. The base 12 may also include a curb 31 extending upward from the second shoulder 27 such that the lip 29 is not grippable to open the container 10, for example, without separating the base 14 and the lid 12 at the tear line 34.

Figure 6:
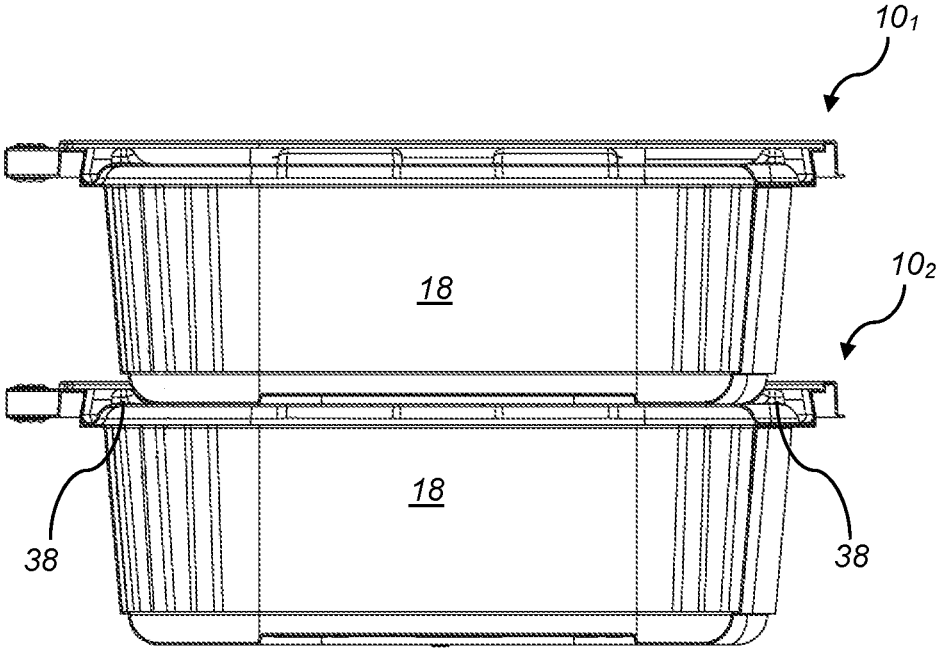
FIG. 6 is a side view of multiple of the containers of FIGS. 1-4 in a stacked configuration.

Referring back to FIGS. 1-4, the lid 14 may further include a plurality of stacking ridges 38 extending upward from the top 15 of the lid 14 and arranged to define an area between which the base 12 of another container 10 may securely fit. The stacking ridges 38 may be configured to engage with the side walls 18 of the base of the other container 10 such that multiple containers 101, 102 are stackable one on top of another in a secured manner, as illustrated in FIG. 6.

Figure 7:
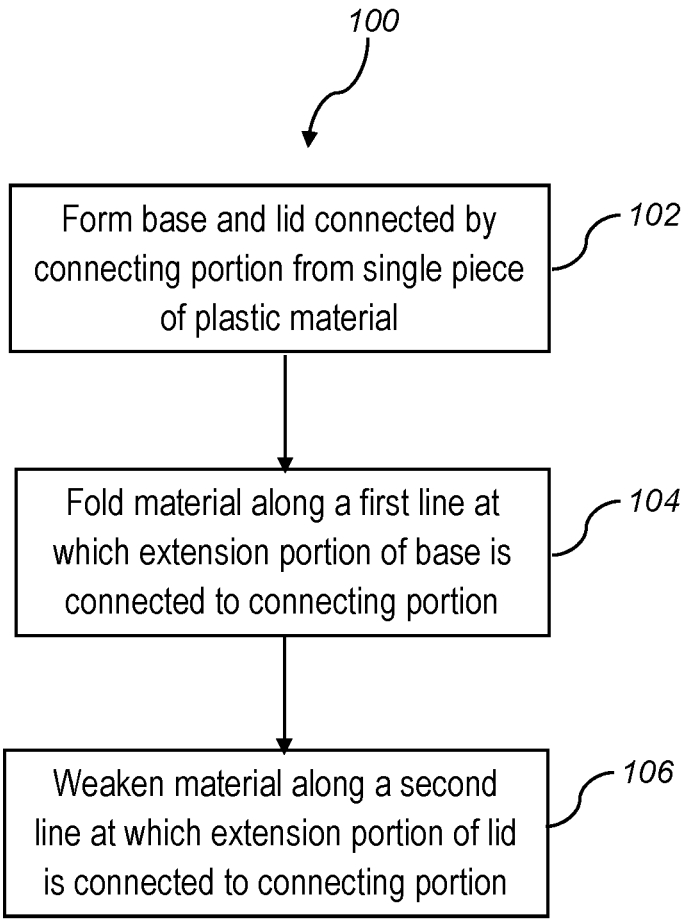
FIG. 7 is a schematic flow diagram of an exemplary method for assembling an assembly of a tool and a tool holder.

Referring now to FIG. 7, an exemplary method 100 for manufacturing a container with a tearable lid, such as the container 10, for providing an indication of tampering is illustrated. While method 100 is described with respect to container 10, it should be appreciated that method 100 may apply to any container in which the steps of method 100 are applicable. Method 100 may begin at step 102 in which a base 12 and a lid 14 are formed from a single sheet of a plastic material with a connecting portion therein. As explained above, the base 14 may have a bottom 16 and a plurality of side walls 18 extending upward from the bottom 16 to define an interior space 20 therebetween, and an extension portion 24 extending laterally outward from a lateral side 26 of the base 12. The extension portion 24 may be connected to the connecting portion 22 via a first line 32. The lid 14 may similarly have an extension portion 28 extending laterally outward from a lateral side 30 of the lid 14. The extension portion 28 may be connected to the connecting portion 22 via a second line 34. The forming of the base 12, lid 14, and connecting portion 22 may be achieved by any process.

After step 102, method 100 may proceed to step 104 at which the first line 32 may be bent or folded such that the connecting portion 22 and the lid 14 are rotatable with respect to the base 12.

After step 104, method 100 may proceed to step 106 at which the second line 34 may be weakened such that the lid 14 may be separable from the connecting portion 22 and the base 12 at the second line 34, for example, via tearing. The weakening may be done by any process, including, but not limited to, perforating the material along the second line 34.

Method 100 may end after step 106.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

It will be appreciated that the aforementioned method and devices may be modified to have some components and steps removed, or may have additional components and steps added, all of which are deemed to be within the spirit of the present disclosure. Even though the present disclosure has been described in detail with reference to specific embodiments, it will be appreciated that the various modifications and changes can be made to these embodiments without departing from the scope of the present disclosure as set forth in the claims. The specification and the drawings are to be regarded as an illustrative thought instead of merely restrictive thought.

All terms used in the claims are intended to be given their broadest reasonable constructions and their ordinary meanings as understood by those knowledgeable in the technologies described herein unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A container comprising:

a base having a bottom and a plurality of side walls extending upward from at least a portion of the bottom to define an interior there between;

a lid configured to engage with the base in a closed configuration to enclose the interior; and a connecting portion by which the base and the lid are connected in an initial state;

wherein the base has an extension portion extending laterally outward from a lateral side of the base and connected to the connecting portion via a folding line about which the connecting portion and the lid are rotatable with respect to the base between the closed configuration and an open configuration;

wherein the lid has an extension portion extending laterally outward from a lateral side of the lid and connected to the connecting portion via a tear line, the tear line being weakened such that the lid is separable from the connecting portion and the base at the tear line while the connecting portion remains intact with the extension portion of the base; and wherein the extension portion of the base and the extension portion of the lid extend a same distance laterally outward such that the connecting portion is oriented vertically in the closed configuration in the initial state.

2. The container of claim 1, wherein the extension portion of the base and the extension portion of the lid have substantially a same longitudinal length.

3. The container of claim 1, wherein the connecting portion has a shorter longitudinal length than the extension portions.

4. The container of claim 3, wherein the connecting portion is centered in a longitudinal direction with respect to at least the extension portions.

5. The container of claim 1, wherein at least one longitudinal end of at least one of the extension portions has a roughened portion to form a gripping portion.

6. The container of claim 1, wherein:

the lid includes a top, a bubble portion extending downward from and arranged around at least a portion of a periphery of the top, and a lid sealing wall extending upward from the bubble portion;

the base includes a first shoulder extending outward from the plurality of side walls in a direction away from the interior, and a base sealing wall extending upward from the first shoulder to form a pocket configured to receive the bubble portion; and the lid sealing wall and the base sealing wall are configured to engage with each other via a compression fit when the bubble portion is received in the pocket to maintain the container in a closed configuration.

7. The container of claim 6, wherein the base sealing wall and the first shoulder form an acute angle.

8. The container of claim 6, wherein:

the base includes a second shoulder extending outward from the base sealing wall; and the lid includes a lip extending outward from the lid sealing wall, the lip configured to engage with the second shoulder.

9. The container of claim 8, wherein the base includes a curb extending upward from and arranged around at least a portion of a periphery of the second shoulder such that the lip of the lid is inaccessible.

10. The container of claim 1, wherein the lid includes a plurality of stacking ridges extending upward from a top surface of the lid and arranged to define an area between which the base of another container is fittable, the stacking ridges being configured to engage with the side walls of the base of the other container such that multiple containers are stackable one on top of another in a secured manner.

11. The container of claim 1, wherein the bottom of the base includes a single portion arranged substantially parallel to the lid in the closed configuration.

12. A method comprising: forming from a single sheet of a plastic material a base and a lid connected to each other via a connecting portion, the base having a bottom and a plurality of side walls extending upward from at least a portion of the bottom to define an interior therebetween, and an extension portion extending laterally outward from a lateral side of the base and connected to the connecting portion via a first line, and the lid having an extension portion extending laterally outward from a lateral side of the lid and connected to the connecting portion via a second line; folding the plastic material along the first line such that the connecting portion and the lid are rotatable about the first line with respect to the base between a closed configuration, in which the lid is engaged with the base to enclose the interior, and an open configuration; and weakening the plastic material along the first line such that the lid is separable from the connecting portion and the base at the second line while the connecting portion remains intact with the extension portion of the base; wherein the connecting portion has a shorter longitudinal length than the extension portions, and is located longitudinally at an intermediate location of the extension portions such that each extension portion extends longitudinally beyond both longitudinal ends of the connecting portion; wherein the extension portion of the base and the extension portion of the lid extend a same distance laterally outward such that the connecting portion is oriented vertical in the closed configuration in the initial state.

13. The method of claim 12, wherein the extension portion of the base and the extension portion of the lid have substantially a same longitudinal length.

14. The method of claim 12, wherein the connecting portion is centered in a longitudinal direction with respect to at least one of the extension portions.

15. The method of claim 12, wherein at least one longitudinal end of at least one of the extension portions has a roughened portion to form a gripping portion.

16. The method of claim 12, wherein:

the lid includes a top, a bubble portion extending downward from and arranged around at least a portion of a periphery of the top, and a lid sealing wall extending upward from the bubble portion;

the base includes a first shoulder extending outward from the plurality of side walls in a direction away from the interior, and a base sealing wall extending upward from the first shoulder to form a pocket configured to receive the bubble portion; and the lid sealing wall and the base sealing wall are configured to engage with each other via a compression fit when the bubble portion is received in the pocket to maintain the container in the closed configuration.

17. The method of claim 12, wherein the lid includes a plurality of stacking ridges extending upward from a top surface of the lid and arranged to define an area between which the base of another container is fittable, the stacking ridges being configured to engage with the side walls of the base of the other container such that multiple containers are stackable one on top of another in a secured manner.

18. A container comprising:

a base having a bottom and a plurality of side walls extending upward from the bottom to define an interior there between;

a lid configured to engage with the base in a closed configuration to enclose the interior;

a connecting portion by which the base and the lid are connected in an initial state;

wherein the base includes:

a first shoulder extending outward from the plurality of side walls in a direction away from the interior;

a base sealing wall extending upward from the first shoulder to form a pocket configured to receive a bubble portion of the lid; and an extension portion extending laterally outward from a lateral side of the base and connected to the connecting portion via a folding line about which the connecting portion and the lid are rotatable with respect to the base between the closed configuration and an open configuration;

wherein the lid includes:

a top to substantially cover the interior;

the bubble portion, which extends downward from and arranged around at least a portion of a periphery of the top;

a lid sealing wall extending upward from the bubble portion; and an extension portion extending laterally outward from a lateral side of the lid and connected to the connecting portion via a tear line, the tear line being weakened such that the lid is separable from the connecting portion and the base at the tear line while the connecting portion remains intact with the extension portion of the base;

wherein the lid sealing wall and the base sealing wall are configured to engage with each other via a compression fit when the bubble portion is received in the pocket to maintain the container in the closed configuration;

wherein the connecting portion has a shorter longitudinal length than the extension portions, and is located longitudinally at an intermediate location of the extension portions such that each extension portion extends longitudinally beyond both longitudinal ends of the connecting portion; and wherein the extension portion of the base and the extension portion of the lid extend a same distance laterally outward such that the connecting portion is oriented vertically in the closed configuration in the initial state.

* * * * *